US010260203B2

(12) United States Patent
Lintz

(10) Patent No.: US 10,260,203 B2
(45) Date of Patent: Apr. 16, 2019

(54) MACHINE FOR STABILIZING A TRACK

(71) Applicant: Plasser & Theurer Export von Bahnbaumaschinen Gesellschaft m.b.H., Vienna (AT)

(72) Inventor: Gerard Lintz, Bening-les-Saint-Avold (FR)

(73) Assignee: Plasser & Theurer Export von Bahnbaumaschinen Gesellschaft m.b.H., Vienna (AT)

( * ) Notice: Subject to any disclaimer, the term of this patent is extended or adjusted under 35 U.S.C. 154(b) by 214 days.

(21) Appl. No.: 15/323,785

(22) PCT Filed: Jul. 16, 2015

(86) PCT No.: PCT/EP2015/001458
§ 371 (c)(1),
(2) Date: Jan. 4, 2017

(87) PCT Pub. No.: WO2016/023609
PCT Pub. Date: Feb. 18, 2016

(65) Prior Publication Data

US 2017/0159244 A1 Jun. 8, 2017

(30) Foreign Application Priority Data

Aug. 13, 2014 (AT) ..... A 630/2014
Mar. 3, 2015 (AT) ..... A 110/2015

(51) Int. Cl.
*E01B 27/12* (2006.01)
*E01B 27/13* (2006.01)
(Continued)

(52) U.S. Cl.
CPC ..... *E01B 27/13* (2013.01); *E01B 27/12* (2013.01); *E01B 27/17* (2013.01); *E01B 27/20* (2013.01)

(58) Field of Classification Search
CPC ..... E01B 27/12; E01B 27/13; E01B 27/17; E01B 27/20; E01B 2203/16; E01B 2203/127
See application file for complete search history.

(56) References Cited

U.S. PATENT DOCUMENTS 4,064,807 A * 12/1977 Theurer ..... E01B 27/13 104/7.3
4,449,459 A 5/1984 Cicin-Sain
(Continued)

FOREIGN PATENT DOCUMENTS

AT 301599 B 9/1972
AT 337241 B 6/1977
(Continued)

OTHER PUBLICATIONS

International Search Report of PCT/EP2015/001458, dated Oct. 21, 2015.

*Primary Examiner* — Mark T Le
(74) *Attorney, Agent, or Firm* — Collard & Roe, P.C.

(57) ABSTRACT

A machine (1) for stabilization of a track (2) has a machine frame (5), mobile on the track by means of on-track undercarriages, on which a stabilizing unit (4) is arranged which has vertical adjustment drives (6) as well as a vibration exciter (7). The stabilizing unit is designed to be displaceable relative to the machine frame (5) in a longitudinal direction (23) of the machine by means of a longitudinal displacement drive (24).

6 Claims, 1 Drawing Sheet

Figure 1:
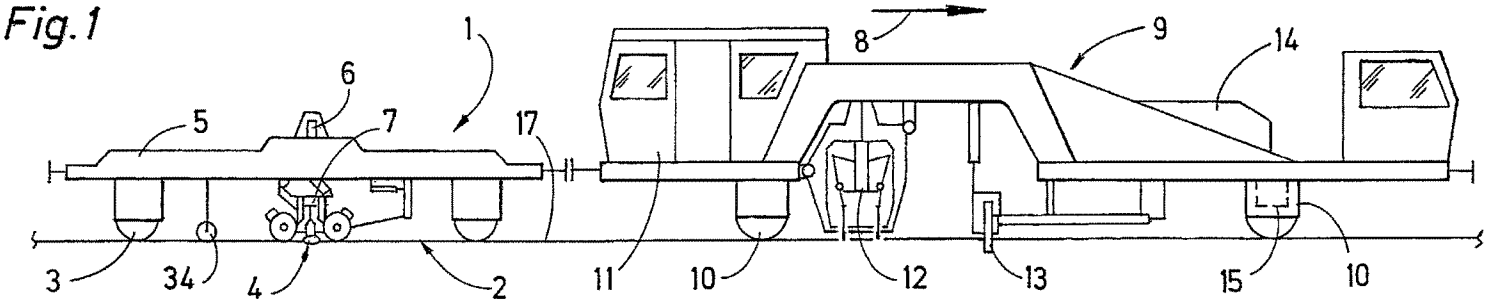

(51) Int. Cl.
*E01B 27/17* (2006.01)
*E01B 27/20* (2006.01)

(56) References Cited

U.S. PATENT DOCUMENTS 4,457,237 A * 7/1984 Theurer ..... B60T 8/1705 104/12
5,419,259 A * 5/1995 Theurer ..... E01B 27/13 104/2
5,640,909 A 6/1997 Theurer

FOREIGN PATENT DOCUMENTS

| | | | |
|---|---|---|---|
| AU | 2004226940 | A1 | 5/2005 |
| CA | 1039113 | A | 9/1978 |
| CH | 652430 | A5 | 11/1985 |
| DE | 26 05 969 | A1 | 9/1976 |
| DE | 3409852 | A1 | 7/1985 |
| DE | 202004013631 | U1 | 11/2001 |
| EP | 0 726 360 | A1 | 8/1996 |
| FR | 2691422 | A1 | 11/1993 |
| GB | 1267322 | A | 3/1972 |
| GB | 2151675 | A | 7/1985 |

* cited by examiner

MACHINE FOR STABILIZING A TRACK

CROSS REFERENCE TO RELATED APPLICATIONS

This application is the National Stage of PCT/EP2015/001458 filed on Jul. 16, 2015, which claims priority under 35 U.S.C. § 119 of Austrian Application No. A 630/2014 filed on Aug. 13, 2014 and Austrian Application No. A 110/2015 filed on Mar. 3, 2015, the disclosures of which are incorporated by reference. The international application under PCT article 21(2) was not published in English.

The invention relates to a machine for stabilization of a track, including a machine frame mobile on the track by means of on-track undercarriages and a stabilizing unit which has vertical adjustment drives as well as a vibration exciter.

In EP 0 726 360, a machine of this type, known as a track stabilizer, is already described which is coupled to a track tamping machine mobile in steps during working operations, and which, after tamping, lowers the track into a target position in a controlled way by means of vibrations under vertical load. With the aid of a control system, the tamping- and stabilizing sequences can be coordinated with one another, wherein the machine frame of the stabilizer is designed to be adjustable relative to the machine frame of the tamping machine by means of a longitudinal displacement drive.

It is the object of the present invention to provide a machine of the kind mentioned at the beginning with which improved controlling of the stabilizing unit during operations is possible.

According to the invention, this object is achieved with a machine of the specified type by way of the features cited in the characterizing part of the main claim.

With this structurally simple and robust configuration, it is possible during working operations to move the stabilizing unit forward continuously on the track in the working direction, while at the same time the machine frame—which is coupled to the tamping machine—is moved together with the latter in steps or cyclically. Thus it is possible in an advantageous way to avoid a situation where, during the stopping phase of the tamping machine, the stabilizing unit acts on the track for too long at the same position and thus the track is lowered too much in places, from which an altogether uneven work result would ensue.

Additional advantages of the invention become apparent from the dependent claims and the drawing description.

Figure 2:
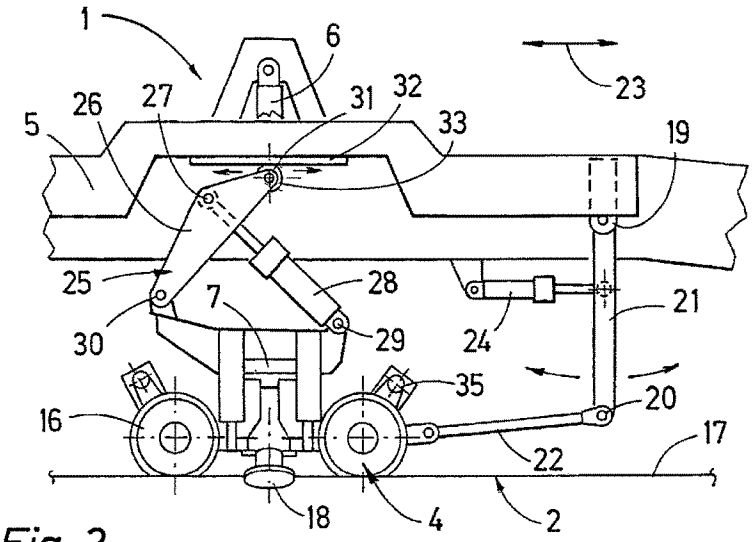
Figure 3:
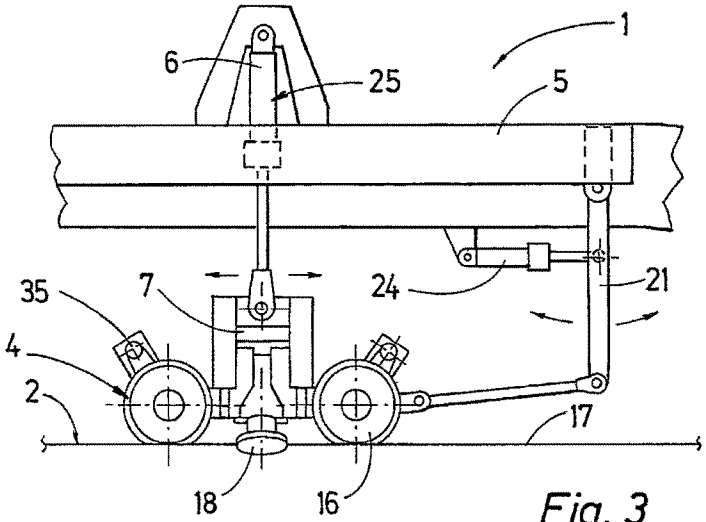

The invention will be described in more detail below with reference to an embodiment represented in the drawing in which FIG. 1 is a side view of a machine according to the invention, coupled to a tamping machine, FIG. 2 is an enlarged detail view of the stabilizing unit of FIG. 1, and FIG. 3 is a further variant of the invention.

A machine 1, shown in FIG. 1, for stabilization of a track 2 has a machine frame 5 which is mobile on the track by means of on-track undercarriages 3 and connected to a stabilizing unit 4. The stabilizing unit 4—which will be described in more detail below with reference to FIG. 2—is designed for vertical adjustment via vertical adjustment drives 6 and equipped with a vibration exciter 7. The machine frame 5 is coupled to a tamping machine 9 which is positioned at the front, with regard to a working direction 8, and designed for cyclic tamping, and which is supported on the track 2 via on-track undercarriages 10 and equipped with a driver's cabin 11, a track tamping unit 12, a track lifting-lining unit 13, an energy supply unit 14, and a motive drive 15.

As can be seen in FIG. 2, the stabilizing unit 4 is mounted during working operations via flanged rollers 16 on rails 17 of the track 2 and is in engagement with the same by means of laterally pivotable lifting rollers 18. Each flanged roller 16 is connected to a separate, independently actuatable hydraulic drive 35. Preceding the stabilizing unit 4 in the working direction 8, an approximately vertically extending compensating lever 21 is provided which is connected by a first linkage 19 to the machine frame 5 and by a second linkage 20 via a pull rod 22 to the stabilizing unit 4. At a point situated about halfway between the two linkages 19, 20, the compensating lever 21 is connected to a longitudinal displacement drive 24, extending in a longitudinal direction 23 of the machine, which in turn is articulatedly connected to the machine frame 5. In this manner, the stabilizing unit 4 is designed to be displaceable in the longitudinal direction 23 of the machine relative to the machine frame 5.

The stabilizing unit 4 is equipped with a thrusting device 25 for producing a vertical load. Said device consists of a thrust lever 26 which is articulatedly connected to a first end 27 of a thrust drive 28, the second end 29 of which is linked to the stabilizing unit 4. The thrust lever 26, in turn, is articulatedly connected by a lower end 30—with regard to the vertical—to the stabilizing unit 4 while, at an upper end 31, a thrust roller 33 is arranged which is provided for application to the machine frame 5 (or to a plate 32 mounted on the same).

Further provided on the machine 1 is a speedometer 34 (FIG. 1) which is connected to the machine frame 5 and designed to roll on the rail 17 of the track 2. Alternatively, the speedometer could also be connected to the stabilizing unit 4.

During working operations, the tamping machine 9 is moved in steps from sleeper to sleeper of the track 2 and cyclically stopped in each case in order to lower the tamping unit 12 into the track bed for the tamping operation. To the rear in the working direction, the tamped track 2—which is in a temporary vertical position—is set into vibrations by means of the stabilizing unit 4 and, with application of a downward load, is lowered into a target position. In order to prevent the track 2, in the process, from being lowered too much in one place by excessively lengthy stabilizing action during the stopping phase of the tamping machine 9, the stabilizing unit 4 is now moved forward relative to the machine frame 5 by means of the longitudinal displacement drive 24—assisted by actuation of the hydraulic drives 35 of the flanged rollers 16 rolling on the track 2—while the stopping phase continues. With the aid of the speedometer 34 which registers the forward motion of the two machines 1 and 9 coupled to one another, it is possible to control the forward motion by the longitudinal displacement drive 24 correspondingly, or to match it to the forward motion of the machine in such a way that an optimal working result is achieved.

Shown in FIG. 3 is an alternative version of the invention in which the thrusting device 25 is formed by the vertical adjustment drive 6, wherein the vertical load is applied by the latter to the rails 17. Since, as a result of the displacement motion of the stabilizing unit 4 relative to the machine frame 5, the length of the vertical adjustment drive 6 changes continuously, the latter is continually readjusted by means of a control device (not shown) in order to keep the vertical load upon the rails 17 of the track 2 constant.

The invention claimed is:

1. A machine for stabilization of a track comprising:

a machine frame mobile on the track by means of a plurality of on-track undercarriages coupled to the machine frame;

a stabilizing unit comprising a plurality of vertical adjustment drives and a vibration exciter;

wherein the stabilizing unit is designed to be displaceable relative to the machine frame in a longitudinal direction of the machine by means of a longitudinal displacement;

wherein, between the machine frame and the stabilizing unit, a thrust drive is provided which is articulatedly connected at a first end to a thrust lever and by a second end to the stabilizing unit, wherein the thrust lever has a lower end—with regard to the vertical—which is articulatedly connected to the stabilizing unit while a thrust roller provided for application to the machine frame is arranged at an upper end.

2. A machine for stabilization of a track comprising:

a machine frame mobile on the track by means of a plurality of on-track undercarriages coupled to the machine frame; and a stabilizing unit comprising a plurality of vertical adjustment drives and a vibration exciter;

wherein the stabilizing unit is designed to be displaceable relative to the machine frame in a longitudinal direction of the machine by means of a longitudinal displacement wherein a compensating lever is provided which is connected by a first linkage to the machine frame and by a second linkage to the stabilizing unit, and wherein the longitudinal displacement drive is connected between the two linkages to the compensating lever.

3. The machine according to claim 1, wherein a speedometer connected to the stabilizing unit or the machine frame is provided which is designed to roll on a rail of the track.

4. The machine according to claim 1, wherein flanged rollers, designed to roll on the track, of the stabilizing unit are connected in each case to a separate, independently actuatable hydraulic drive.

5. The machine according to claim 2, wherein a speedometer connected to the stabilizing unit or the machine frame is provided which is designed to roll on a rail of the track.

6. The machine according to claim 2, wherein flanged rollers, designed to roll on the track, of the stabilizing unit are connected in each case to a separate, independently actuatable hydraulic drive.

* * * * *